US005692730A

United States Patent [19]

Gill

[11] Patent Number: 5,692,730

[45] Date of Patent: Dec. 2, 1997

[54] PINLESS JACK

[75] Inventor: Bryan D. Gill, Newmarket, Canada

[73] Assignee: Ventra Group Inc., Ontario, Canada

[21] Appl. No.: 551,748

[22] Filed: Nov. 7, 1995

[51] Int. Cl.[6] ..... B66F 3/22

[52] U.S. Cl. ..... 254/122; 254/126; 254/DIG. 1

[58] Field of Search ..... 254/DIG. 8, 124, 254/126, 122, DIG. 1

[56] References Cited

U.S. PATENT DOCUMENTS

| | | | |
|---|---|---|---|
| 4,802,653 | 2/1989 | Engel | 254/126 |
| 5,139,232 | 8/1992 | Bailey | 254/126 |
| 5,176,362 | 1/1993 | Seksaria et al. | 254/126 |
| 5,261,644 | 11/1993 | Armstrong | 254/126 |
| 5,303,898 | 4/1994 | Engel et al. | 254/126 |

*Primary Examiner*—Robert C. Watson
*Assistant Examiner*—Thomas W. Lynch
*Attorney, Agent, or Firm*—Cushman Darby & Cushman Intellectual Property Group of Pillsbury Madison & Sutro, LLP

[57] ABSTRACT

This invention relates to the construction of a pantograph jack and, in particular, to an improvement in the construction of a pantograph jack wherein the pins connecting the arms to the base and load rest of the jack are replaced with extrusions emanating from those parts. In particular, the pantograph jack of this invention has four arms, including two lower arms, and two upper arms. Each of the lower arms has a gear end to rotate with respective gear ends mounted in a base, meshing to control the rotation of one lower arm with respect to the other lower arm. Each of the upper arms has a gear end mounted in a load rest to rotate with the gear ends of both upper arms meshing to control the rotation of one upper arm with respect to the other upper arm. The improvement comprises axles extruded at positions on axes of rotation of one or more of the gear ends, and the axles providing means to mount the arms in the base or the load rest.

2 Claims, 3 Drawing Sheets

PINLESS JACK

FIELD OF THE INVENTION

This invention relates to the construction of a pantograph jack and, in particular, to an improvement in the construction of a pantograph jack wherein the pins connecting the arms to the base and load rest of the jack are replaced with extrusions emanating from those parts.

BACKGROUND OF THE INVENTION

A portable jack is often stored in a vehicle to enable a driver to lift the vehicle to effect emergency repairs, for example, to change a tire. One popular type of jack for automobiles is the pantograph jack. Known pantograph jacks typically have four arms hinged in a parallelogram at four joints. One joint is located on a base of the jack. Another joint is positioned at a load rest vertically above the base. Two other free floating joints are located on a horizontal diagonal at opposite corners of the parallelogram formed by the arms. When the free floating joints are drawn together in a horizontal plane the arms extend vertically to lift the load support with respect to the base and vice versa. The relative position of the free floating joints is controlled by a threaded drive shaft which links them together.

Modern jack design places increasing emphasis on low cost manufacture and light weight. Manufacturing costs may be reduced by reduction in material requirements and minimization of manufacturing and assembly steps. Reducing material requirements also reduces weight. The joints at the base and the load rest of a pantograph jack are typically made with pins. For example, the lower pantograph arms have ends with gear teeth which mesh within the base as the arms turn in opposite radial directions. To achieve this meshing and turning each lower end of the two arms is set to rotate on a pin in the base. Aligned holes penetrate each lower end and the base to receive a pin. Similar arrangements are made to connect the upper arms in the load rest. It is an object of this invention to simplify the construction of these joints to reduce costs and weight.

SUMMARY OF THE INVENTION

The present invention is directed to a pantograph jack having four arms including two lower arms and two upper arms. Each lower arm of such jack has a gear end mounted in a base to rotate so that the gear ends of both lower arms mesh together to conform the rotation (in opposite directions) of each lower arm to the other. Similarly, each upper arm has a gear end mounted in a load rest to rotate with the gear ends of both upper arms meshing to conform the rotation of each upper arm to the other. Usually a jack of this construction has pins inserted through each arm gear end and the base or load rest to act as axles to locate the arms for rotation.

The improvement of this invention comprises one or more axles extruded at positions on the axes of rotation of one or more gear ends to mount the arms in the base or the load rest. The words "the axles are extruded at positions on the axes of rotation of one or more gear ends" (or the like) are used in this specification to mean that the axles could be extruded from the arms to fit into a base or load rest or, alternatively, extruded from the base and the load rest to fit into the arms.

A pantograph jack of this invention may have each arm similarly constructed to reduce tooling costs. For example, each arm could have a channel shape with two side flanges joined by a web. One end of each flange of each arm may have a jaw to connect about a trunnion laterally extending from a connector means mounted (in either a sliding or threaded connection) on the drive shaft to form either of the two free floating joints. An opposite end of each flange may have a gear end. Two such arms may be mounted in a base to rotate with their gear ends meshing to form lower arms. Two such arms may be similarly mounted in a load rest to form upper arms. The uniform construction may be continued with axles extruded at positions on the axes of rotation of the gear ends for connection into the base or load rest. For example, each arm may have a portion or its gear end on its axis of rotation extruded as an axle to rotate in a hole or notch in the base or load rest. Alternatively, the base and load rest may have the extruded axles to connect to notches or holes in the arms. In this specification "aperture" will be used in the sense of a perforating hole or an indenting notch to receive an axle. It will be appreciated that the suitability of either to retain an axle under the forces of a load is a matter of selection and engineering design for a particular jack which is within the skill of the art and does not require elaboration here.

DESCRIPTION OF THE FIGURES

In the figures which illustrate a preferred embodiment of this invention.

DESCRIPTION OF THE INVENTION

Figure 1:
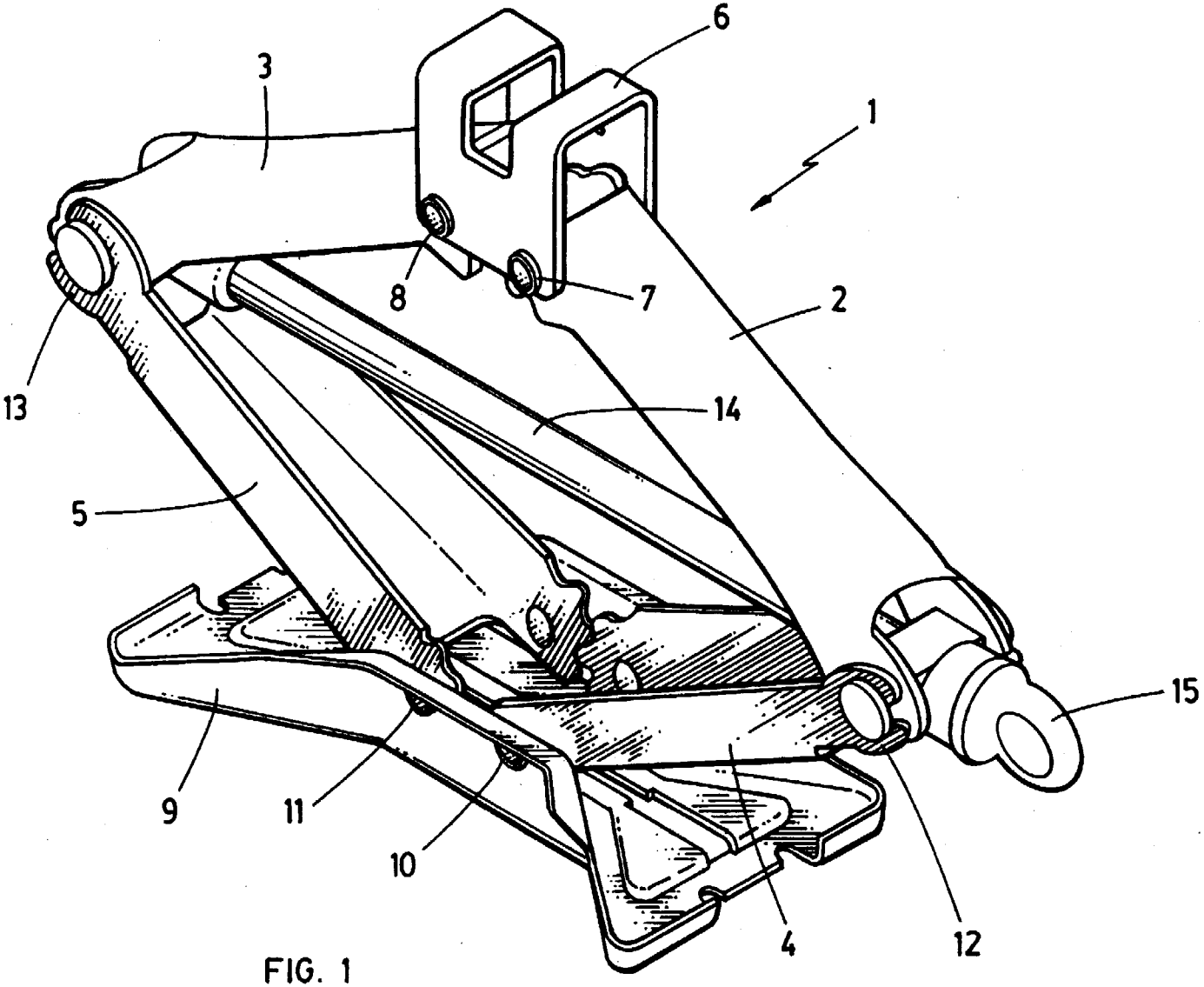
FIG. 1 is a schematic illustration of a pantograph jack having pinless joints.

As illustrated in FIG. 1, a pantograph jack 1 has four arms namely, a right upper arm 2, a left upper arm 3, a right lower arm 4, and a left lower arm 5. The upper arms 2 and 3 are hinged in a load rest 6 at apertures 7 and 8 respectively. The lower arms 4 and 5 are hinged in a base 9 at apertures 10 and 11 respectively. (It will be appreciated that there are corresponding apertures 7', 8', 10', and 11' on the other side of the jack) Two free floating joints 12 and 13 are located on a horizontal diagonal at opposite corners of the parallelogram formed by the arms 2, 3, 4 and 5. The horizontal position of the free floating joints 12 and 13 and, accordingly, the vertical position of the load rest 6 relative to the base 9 is controlled by a drive shaft 14 which links joints 12 and 13 together. At joint 12, a trunnion links the lower arm 4 and the upper arm 2 and receives the drive shaft 14 in an unthreaded or passive connection. At joint 13, a second trunnion links the upper arm 3 and the lower arm 5 and receives the drive shaft 14 in a threaded or active connection. The drive shaft 14 is driven by a crank or other means (not shown and not material to the invention) which connects to an eye connection 15 at an end of the drive shaft 14. The eye connection 15 bears on the trunnion to force it inward while the drive shaft 14 turns within the second, threaded, trunnion to force the jack 1 upwards. Similarly, the trunnion is released (or pushed by another bearing surface on the drive shaft 14) outwardly as drive shaft 14 is reversed to lower the jack 1. In FIG. 1 the joints at apertures 7, 8, 10 and 11 are formed without conventional pins.

Figure 2:
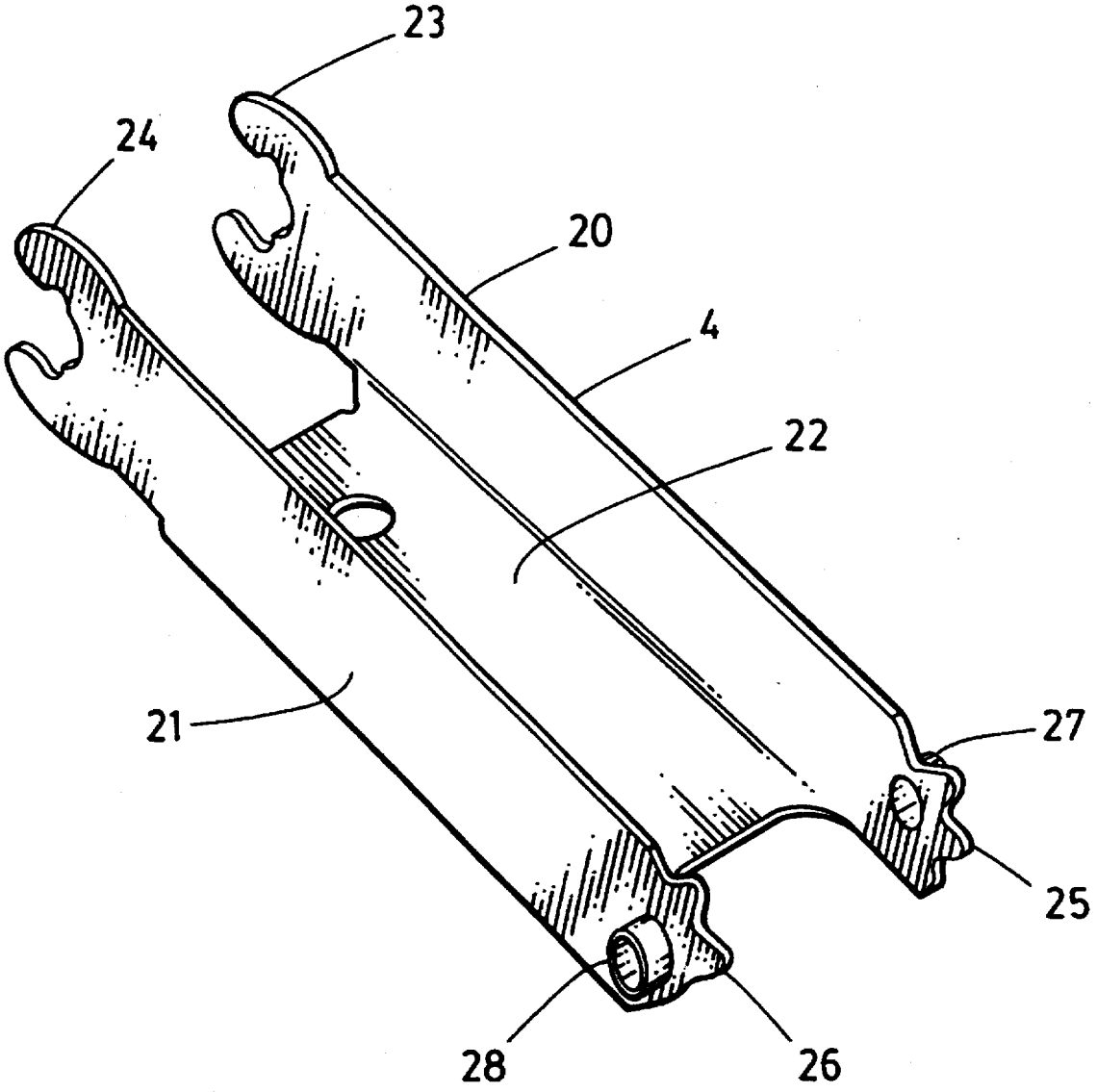
FIG. 2 illustrates an arm of a pantograph jack having extrusions.

FIG. 2 illustrates a preferred embodiment of a uniform pantograph arm 4 of this invention. The arm 4 is channel shaped with flanges 20 and 21 joined by a web 22. One end of each flange 20 and 21 has a jaw, 23 and 24 respectively, to connect about a trunnion in free floating joint 12 (See FIG.

1). The other ends of flanges 20 and 21 are formed to gear ends, 25 and 26 respectively, which will mesh with similar gear ends on arm 5 when both arms 4 and 5 are mounted in the base 9. At the axes of rotation of the gear ends 25 and 26, extrusions are pushed out of the flanges 20 and 21 to provide axles 27 and 28 for connection into the base 9.

Figure 3:
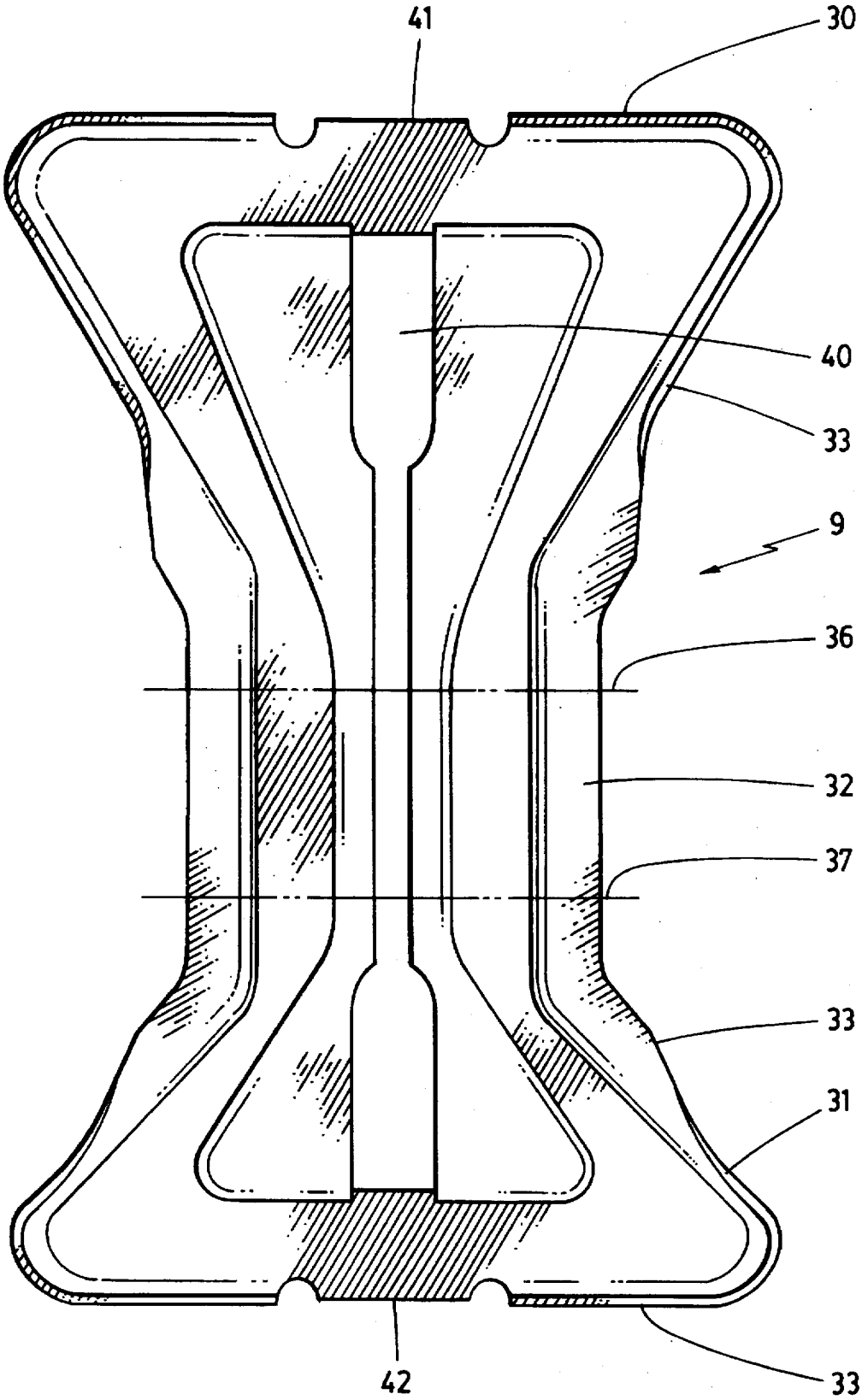
FIG. 3 illustrates a base of a jack constructed to receive the pantograph arms of this invention.

FIG. 3 depicts the base 9 which, in plan view, resembles a bow tie having flared ends 30 and 31 and a narrower neck 32. The perimeter of the base 9 is surrounded by a raised flange 33 which provides a member into which the arms 4 and 5 can be located and also provides strength and rigidity. The characteristics of the flange 33 are generally within the skill of the art and are determined in part by the dimensions of the arms and the base, the selection of materials and the size of the loads anticipated with a view to providing adequate strength and stiffness to the base. Apertures 10, 10', 11 and 11' are provided in the flange 33 at the intersection of the axes of rotation 36 and 37 of the arms 4 and 5. For example, two aligned apertures 10 and 10' are provided on the axis of rotation 36 of arm 4 to receive the axles 27 and 28.

In a preferred manufacturing process the axles 27 and 28 are inserted into the apertures 10 and 10' during assembly by bending the flange 33 open to receive the arm 4 and allowing it to close resiliently back over the axles 27 and 28. Similarly the arm 5 is inserted into the base 9. The base 9 may be adapted with a slot 40 cut through its long axis to facilitate opening to receive the arms 4 and 5. For the same reason, cutouts 41 and 42 may be provided centrally in the flange 33 at the ends 30 and 31 of the base 9.

All arms of the jack 1 may be constructed as shown in FIG. 2 thereby simplifying tooling and manufacture. Arms 2, 3 and 5 are obtained by simply orienting an arm 4 of FIG. 2 in a different position and connecting it in the combination of jack parts. Thus upper arms 2 and 3 are similarly formed and similarly fitted into apertures 7, 7', 8 and 8' positioned on the axes of rotation of the upper arms in load rest 6 as shown in FIG. 1. Many load rests do not require modification, ie., slots or cutouts, to force the arms into the apertures.

It will be appreciated that where an axle is inserted into an aperture comprising a hole, the end of the axle can be upset or coined over, or otherwise adapted in ways known to skilled persons, to fix the axle in the hole while retaining its ability to rotate. It will also be appreciated that the axles could be extruded from the flanges of the arms or, alternatively, from the side flange of the base or a corresponding flange of a load rest to be inserted into apertures in the arms.

The foregoing description of the preferred embodiments of this invention is directed to one skilled in the art and is explanatory rather than limiting of the features of this invention and its manufacture. Equivalents and substitutions that are obvious to skilled persons reading this specification in view of the prior art are intended to be included for all parts described. Dimensions and shapes of the parts shown in the drawings are not essential and may be adapted in accordance with usual engineering practice as is appropriate to particular end uses. Obviously unsuitable materials and dimensions are intended to be excluded.

What I claim is:

1. A pantograph jack having four arms including two lower arms and two upper arms, each arm being uniformly constructed having a channel shape with two side flanges joined by a web, one end of each flange having a jaw to connect about a trunnion of a connection means mounted on a drive shaft, the other end of each flange having a gear end mounted in one of a base or a load rest to rotate about an axis of rotation of said gear end spaced from an axis of rotation of another arm gear end to permit meshing of both said gear ends to control the rotation of one arm with respect to the other arm, in which axles are extruded at positions on the axes of rotation of the gear ends and mounted to rotate in circular apertures provided in at least one of the load rest and the base, the base having an elongated slot having a longitudinal axis perpendicular to the axes of rotation of the gear ends, and extending substantially the entire length of the base to facilitate opening for assembly of the arms within the base.

2. The jack of claim 1 in which the base has a slot extending transversely to said axes of rotation to permit a flange about the base containing the circular apertures to be expanded and to be closed resiliently to receive the axles in the circular apertures during assembly.

* * * * *